US010427829B2

(12) United States Patent
Baker et al.

(10) Patent No.: US 10,427,829 B2
(45) Date of Patent: Oct. 1, 2019

(54) THINNED METAL CAN END

(71) Applicant: Silgan Containers LLC, Woodland Hills, CA (US)

(72) Inventors: Gerald James Baker, Wauwatosa, WI (US); Michael Patrick Moore, Hartford, WI (US)

(73) Assignee: Silgan Containers LLC, Woodland Hills, CA (US)

( * ) Notice: Subject to any disclaimer, the term of this patent is extended or adjusted under 35 U.S.C. 154(b) by 302 days.

(21) Appl. No.: 15/451,131

(22) Filed: Mar. 6, 2017

(65) Prior Publication Data

US 2017/0253370 A1 Sep. 7, 2017

Related U.S. Application Data

(60) Provisional application No. 62/304,613, filed on Mar. 7, 2016.

(51) Int. Cl.

| | |
|---|---|
| ***B65D 6/00*** | (2006.01) |
| ***B65D 8/00*** | (2006.01) |
| ***B65D 6/34*** | (2006.01) |
| ***B65D 17/00*** | (2006.01) |

(52) U.S. Cl.
CPC ..... *B65D 7/42* (2013.01); *B65D 7/04* (2013.01); *B65D 7/48* (2013.01); *B65D 17/08* (2013.01)

(58) Field of Classification Search
CPC . B65D 7/42; B65D 17/08; B65D 7/48; B65D 7/04; B65D 7/44
See application file for complete search history.

(56) References Cited

U.S. PATENT DOCUMENTS

| | | | | |
|---|---|---|---|---|
| 6,419,110 B1 * | 7/2002 | Stodd | ..... | B21D 51/32 220/623 |
| 8,684,211 B1 * | 4/2014 | Stammen | ..... | B21D 37/10 220/269 |

* cited by examiner

*Primary Examiner* — Andrew T Kirsch
*Assistant Examiner* — Don M Anderson
(74) *Attorney, Agent, or Firm* — Reinhart Boerner Van Deuren s.c.

(57) ABSTRACT

A thinned metal can end having a non-uniform thickness profile is provided. The can end has a central panel having at least a first thickness, a middle portion having at least a second thickness greater than the first thickness, and an end portion having at least a third thickness greater than the first and second thicknesses. The can end is configured to be joined to a can wall by a double seam.

19 Claims, 5 Drawing Sheets

THINNED METAL CAN END

CROSS-REFERENCE TO RELATED PARENT APPLICATION

This application claims priority to and the benefit of U.S. Provisional Patent Application No. 62/304,613 filed Mar. 7, 2016, which is incorporated herein by reference in its entirety.

BACKGROUND OF THE INVENTION

The present invention relates generally to the field of 2-piece and 3-piece metal cans. The present invention relates specifically to a thinned metal can end.

SUMMARY OF THE INVENTION

One embodiment of the invention relates to a metal, multi-thickness, one-piece can end formed from a single sheet of metal. The end includes a circular panel having at least a first thickness. The end also includes an annular ridged portion extending from and surrounding the circular panel. The end further includes an annular formation having at least a second thickness. The annular formation extending from and surrounding the ridged area. The second thickness being at least 1.15 times as thick as the first thickness. The annular formation is used to join the end to a can body with a double seam.

Another embodiment of the invention relates to a one-piece can end formed from a single sheet of metal. The end includes an annular double seam formation. The annular double seam portion having at least a first thickness. The annular double seam portion also having a surface furthest from an intersecting first plane. The end also includes an annular ridged portion extending inwardly from the double seam formation. The end further includes a substantially non-planar, circular panel extending from the annular ridged portion. The circular panel having at least a second thickness. The circular panel also intersecting a second plane parallel to and offset from the first plane. The first thickness being at least 1.15 times as thick as the second thickness.

Another embodiment of the invention relates to a one-piece can end formed from a single sheet of metal. The can end includes a circular central panel. The circular panel having a first thickness. The circular panel also having a flat inner portion and sloped outer portion. The sloped outer portion contiguous with and surrounding the inner portion. The central panel comprising at least 24% of the total surface area of the can end. The end further including a middle portion having a plurality of ridges. The middle portion also having at least a second thickness. The first thickness being at least 1.1 times as thick as the second thickness. The middle portion contiguous with and extending radially from the sloped portion of the central panel. The middle portion comprising at least 42% of the total surface area of the can end. The can end also including a curved end portion. The curved end portion having at least a third thickness at least 1.15 times as thick as the first thickness. The curved end portion contiguous with and extending radially from the middle portion. The curved end portion also configured to be rolled into a double seam.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

The canning process allows for the convenient preservation and packaging of food and other products. Generally, an open can body is provided and filled with a product to be preserved or packaged. Then, the product is sealed within the can by joining a can end to the body. In some instances the sealed can is processed to cook or sterilize the product. Cooking the can contents often results in an increased pressure between the interior and exterior of the can often manifesting in a temporary bulging of the can end. The bulging of the can end stresses the weak points of the can end such as the connection point between the end and the can body.

Typical can ends maintain a specific thickness level throughout the can end to prevent the end from rupturing during the heating process or during transport immediately after the heating process. Using a uniform thickness results in a strong end but also in excess material because the thickness throughout must be the maximum thickness required to prevent the end from rupturing at the most vulnerable spot, typically the connection point. Accordingly, Applicant has recognized the need for a multi thickness can end that is thicker at the weak points and thinner at the less vulnerable point. The multi thickness can end allows for a reduction of the material used to manufacture the end and thus results in a significant cost savings in the manufacturing process.

Figure 1:
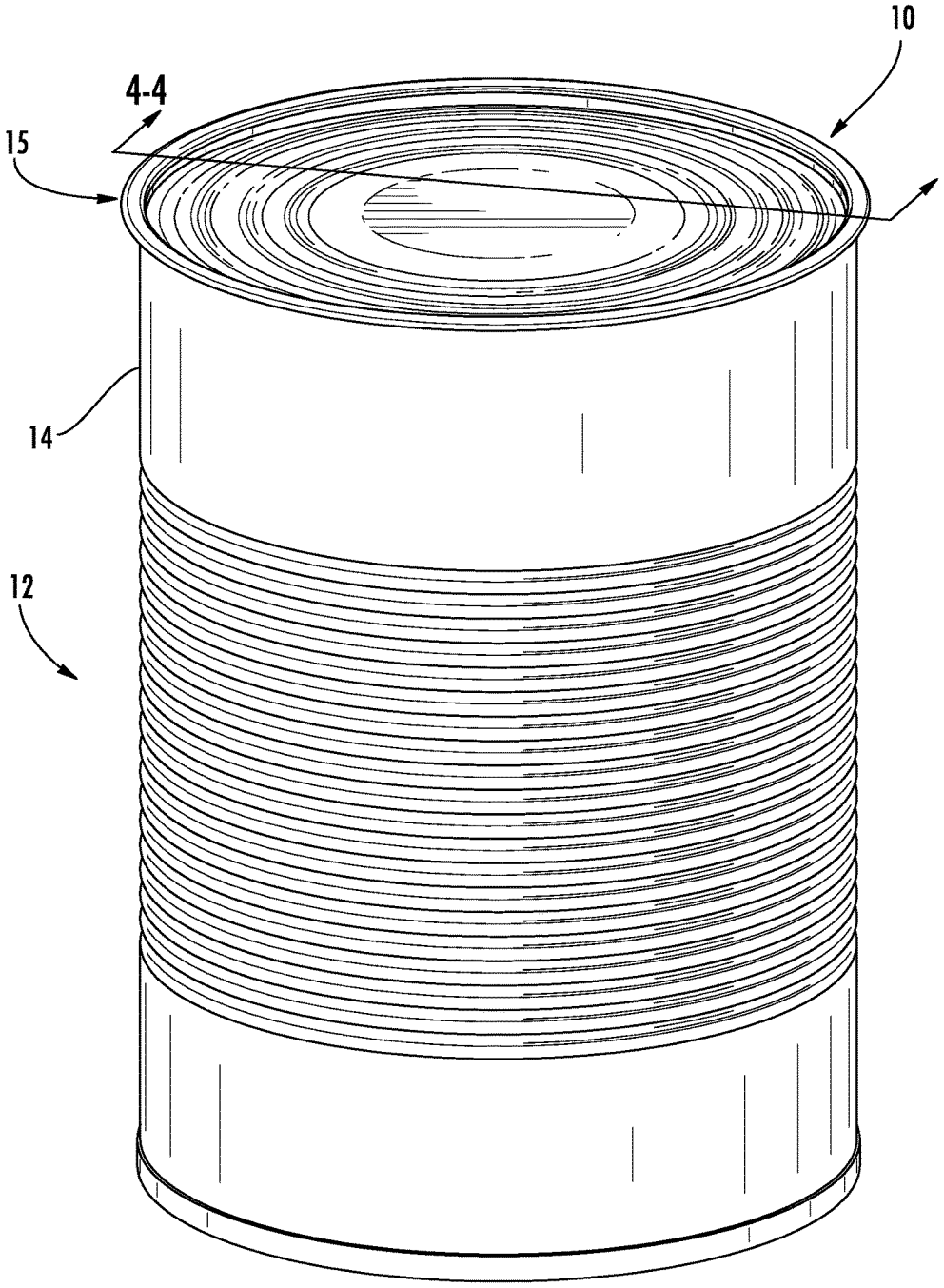
FIG. 1 is a perspective view of an example embodiment of the metal can end joined to a can body by a double seam.

Referring to FIG. 1 an example embodiment of a multi thickness metal can end 10 is shown connected to a can 12. Can 12 includes a wall 14. Can end 10 is formed from a single sheet of metal and is joined to wall 14 by a double seam 15. In one embodiment, can end 10 is formed from T4 steel. Prior to joining can end 10 to can 12, can 12 can be filled with a product (e.g. food, liquid, etc). Joining can end 10 to can 12 seals the product for preservation and storage.

Figure 2:
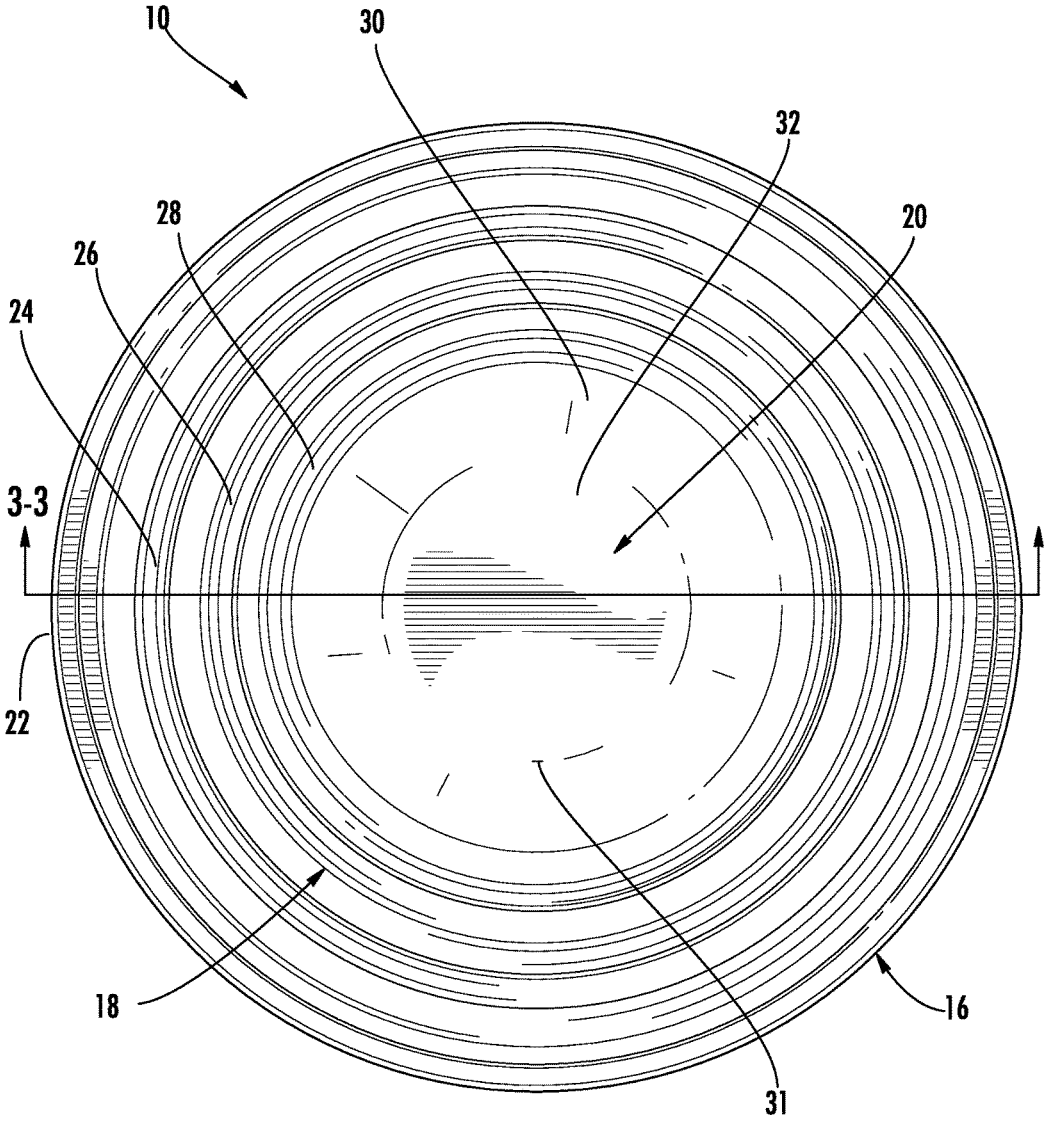
FIG. 2 is a top view of an example embodiment of the can end not joined to a can body by a double seam.

Referring now to FIG. 2, a top view of can end 10 not joined to can 12 is shown. Can end 10 has an annular formation, annular double seam formation, or curved end portion 16, an annular rigid or middle portion 18, and a circular or central panel 20. Can end 10 is formed from a blank piece of steel stock having a first diameter and is then stretched and tooled such that the finished diameter of can end 10 is greater than the first diameter (See FIG. 5). In one embodiment, the first diameter is 6.5 inches and the second diameter is 6.750 inches. The total surface area of can end 10 is between 35.6 and 36.0 square inches. In another embodiment, the total surface area of can end 10 is 35.784 square inches.

Figure 3:
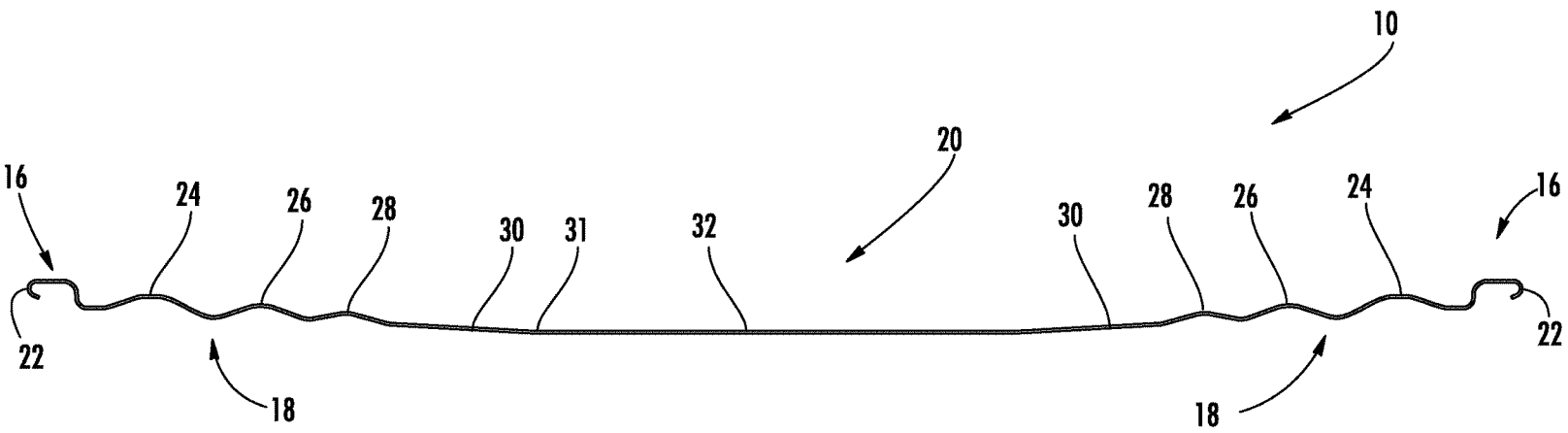
FIG. 3 is a sectional view taken along line 3-3 in FIG. 2.

Annular formation 16 has a curled end 22 (FIG. 3). Annular formation 16 is contiguous with and extends radially from annular rigid portion 18. The surface of annular formation 16 is furthest from an intersecting first plane. Additionally, annular formation 16 extends from and surrounds rigid portion 18. Annular formation 16 has a surface area between 33 and 34 percent of the total surface area and preferably between 33.2 and 33.8 percent of the total surface area. In one embodiment, annular formation 16 has a surface area of 12.026 square inches or at least 33 percent of the total surface area and preferably at least 33.6 percent of the total area.

Rigid portion 18 has a first ridge 24, a second ridge 26, and a third ridge 28. Ridges 18, 24, and 26 are configured to relieve physical stress on can end 10 resulting from heating applied to the joined end 10 and can 12. The ridges act as a bellows allowing for easier expansion and contraction of the can end 10. Additional embodiments having more or fewer ridges are contemplated. Rigid portion 18 is contiguous with annular formation 16 and circular panel 20. Rigid portion 18 extends radially from and surrounds circular panel 20 and extends inward from annular formation 16. Rigid portion 18 has a surface area between 42 and 43 percent of the total surface area and preferably between 42.1 and 42.5 percent of the total surface area. In one embodiment, rigid portion 18 has a surface area of 15.135 square inches or at least 42 percent of the total surface area and preferably at least 42.3 percent of the total surface area.

Circular panel 20 intersects a second plane parallel to and offset from the first plane. Circular panel 20 has a flat inner portion 32 and a sloped outer portion 30. Sloped outer portion 30 is contiguous with and extends radially from inner portion 32. Sloped outer portion 30 and flat inner portion 32 meet at a junction 31. Rigid portion 18 extends radially from sloped outer portion 30. Circular panel 20 has a surface area between 23 and 25 percent of the total surface area and preferably between 23.9 and 24.3 percent of the total surface area. In one embodiment, circular panel 20 has a surface area of 8.625 square inches or at least 24 percent of the total surface area and preferably at least 24.1 percent of the total surface area. In another embodiment, circular panel 20 is substantially non-planar.

Referring to FIG. 3, a sectional view of can end 12 cut along the diameter is shown. The thickness profile of can end 10 is such that circular panel 20 has at least a first thickness, and annular formation 16 has at least a second thickness which is greater than the first thickness. The first thickness is between 5 to 20 percent thinner than the thickness of the original blank and the second thickness is 0 to 15 percent thicker than the original blank. In one embodiment, the second thickness is at least 1.15 times as thick as the first thickness and preferably at least 1.17 times as thick as the first thickness. Alternatively, the second thickness is at least 1.25 times as thick as the first thickness and preferably at least 1.29 times as thick as the first thickness. The first thickness can be between 0.009 and 0.011 inches. The second thickness can be between 0.0119 and 0.0127 inches. In one instance, at least 45% of the circular panel has a thickness within 6% of the first thickness. In another embodiment, rigid portion 18 has at least a third and fourth thickness that are less than the first thickness. The third thickness is between 15 to 25 percent thinner than the original blank and the fourth thickness is between 20 to 30 percent thinner than the original blank. In one embodiment, the first thickness is at least 1.1 times as thick as the third thickness and the first thickness is at least 1.2 times as thick as the fourth thickness. In one embodiment, the first thickness is at least 1.125 times as thick as the third thickness. The thickness of the three ridges can be different at at least one location on each of the respective ridges.

In one embodiment, the thickness profile for can end 10 is such that it is thickest at the outer portion of annular formation 16, thinnest at the center of circular panel 20, and decreasing in-between. In another embodiment, the thickness profile for can end 10 is such that it is thickest at the outer portion of annular formation 16, decreasing in thickness along rigid portion 18 and increasing in thickness towards the middle of circular panel 20. The center of the circular panel being thinner than the thickest point of annular formation 16 and thicker than the thinnest point, which is some point on rigid portion 18.

Figure 4:
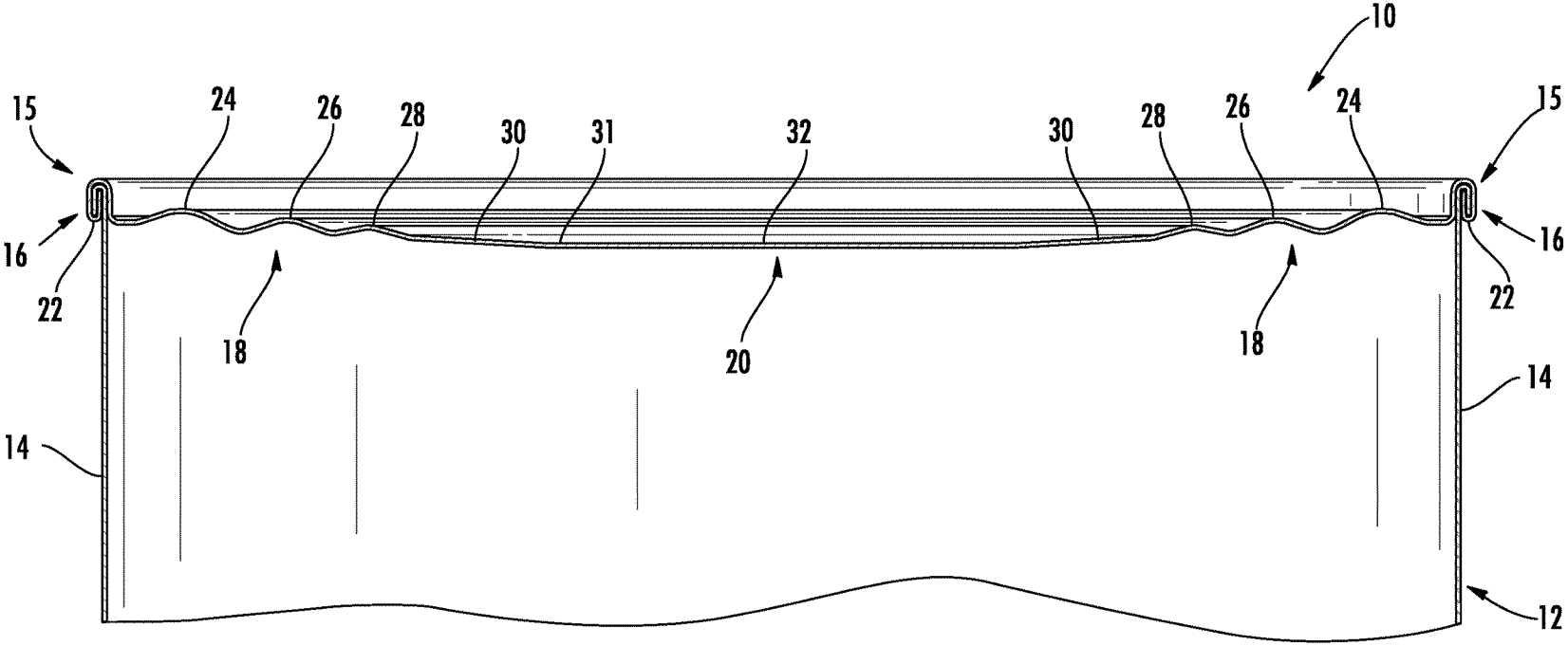
FIG. 4 is a partial sectional view taken along line 4-4 in FIG. 1.

Referring now to FIG. 4. As shown in FIG. 4, can end 10 is configured to be joined to wall 14 of can 12 by a double seam 15. Specifically, curled end 22 is rolled together with a portion of wall 14 to form double seam 15. Double seam 15 seals can end 10 to can 12 to preserve and store any product within can 12.

Figure 5:
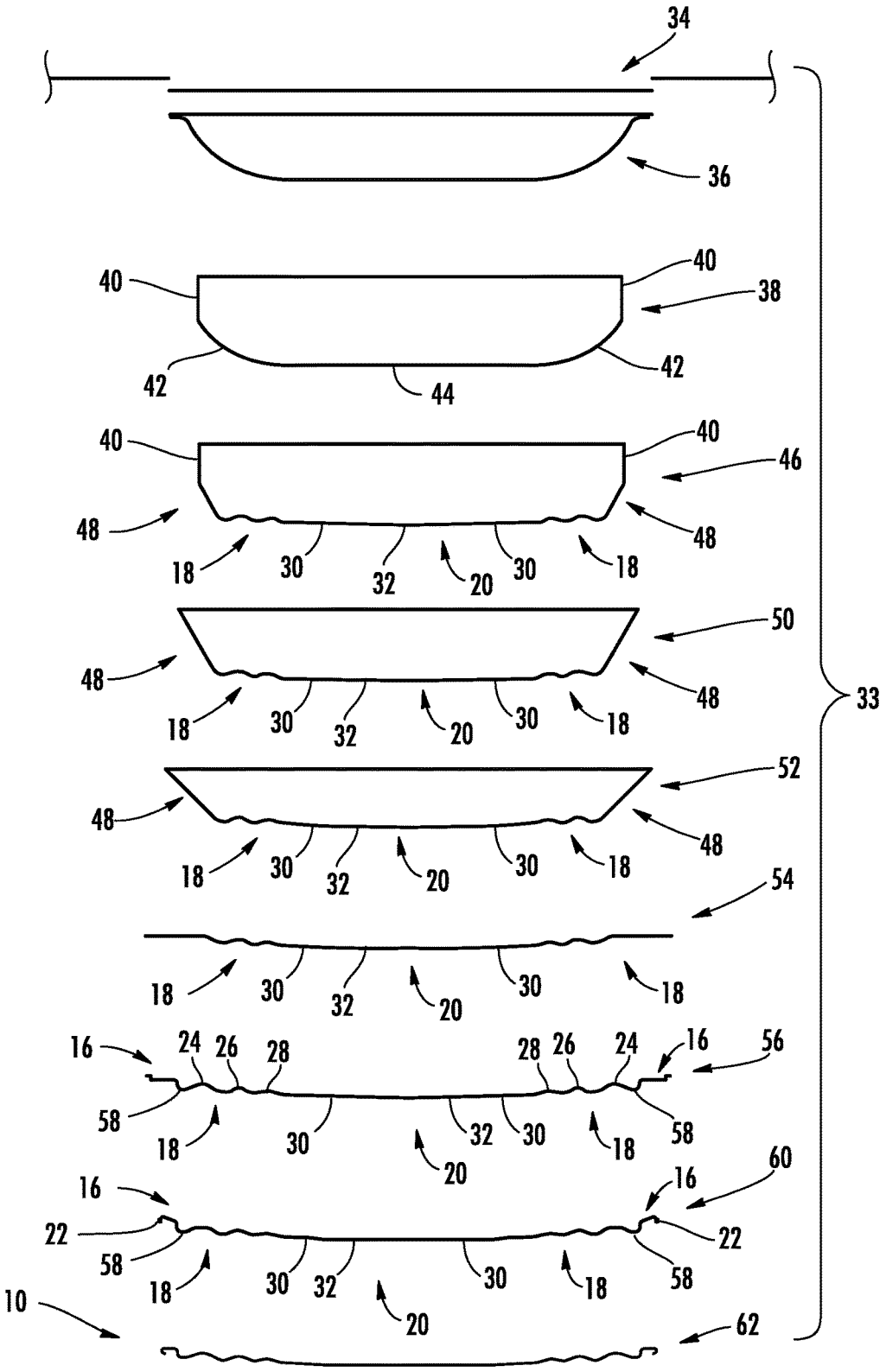
FIG. 5 is a progressive view of an example embodiment of the intermediary forms used to form the completed can end.

Refereeing now to FIG. 5, the intermediary forms 33 used in the process of forming can end 10 are shown. First, a blank 34 is cut from a stock piece of steel having a single uniform thickness such as T4 steel. Blank 34 is then stretched as shown in form 36 until it forms a cup 38. Cup 38 has three discrete sections. The discrete sections are a center portion 44, a radial portion 42 and a vertical portion 40. Forming cup 38 creates a non-uniform thickness profile. In one embodiment, center portion 44 is 5 to 20 percent thinner than the original blank 34, radial portion 42 is between 15 and 30 percent thinner than the original blank 34, and vertical portion 40 is between 0 and 15 percent thicker than original blank 34.

First form 46 is tooled from cup 38. First form 46 forms the bottom of cup 38 into the beginning of annular rigid portion 18 and circular panel 20 of can end 10. The radial portion 42 is formed into side walls 48. Second form 50 aligns the vertical portion 40 with the side walls 48 and then positions side walls 48 at an angle between 30 and 45 degrees. In third form 52, the side walls 48 are positioned at an angle greater than 45 degrees. In fourth form 54, side walls 48 are flattened to align with annular rigid portion 18. Flattening side walls 48 through multiple forms results in a smooth unblemished final surface. Flattening the metal cup in a single step would rip and tear the metal resulting in a non-functional can end. While two intermediary forms 50 and 52 for flattening side walls 48 are shown in FIG. 5, various embodiments employing less than and greater than 2 forms are contemplated.

In fifth form 56, the flattened form is trimmed and a counter sink 58 is formed. Counter sink 58 forms the final ridge 24 of rigid portion 18. Counter sink 58 also forms the start of annular formation 16. In one embodiment the trimming step is omitted. In form 60, the end of annular formation 16 is bent to form curled end 22. In form 62, annular formation 16 is bent down to align with the rest of the end to form the finished can end 10. The curling and bending processes described for forms 60 and 62 can be that of a standard seeming preparation for can ends.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A metal, multi-thickness, one-piece can end formed from a single sheet of metal, having a first surface and a second surface, the end comprising:

a circular panel formed at the center of the sheet of metal, a distance perpendicular to and between the first surface and the second surface at the central panel defining a panel material thickness;

an annular ridged portion formed at a portion of the sheet of metal extending from and surrounding the circular panel; and an annular outside formation formed at a portion of the sheet of metal extending from and surrounding the annular ridged portion, a distance perpendicular to and between the first surface and the second surface at the annular outside formation defining an outside formation material thickness, the outside formation material thickness being at least 1.15 times as thick as the panel material thickness, wherein the annular formation is used to join the end to a can body with a double seam.

2. The end of claim 1, wherein the distance perpendicular to and between the first surface and the second surface at the annular ridged portion defines a portion material thickness, the panel material thickness being at least 1.1 times as thick as the portion material thickness.

3. The end of claim 2, wherein the outside formation material thickness is at least 1.25 times as thick as the panel material thickness.

4. The end of claim 3, wherein at least 45% of the circular panel has a thickness within 6% the panel material thickness.

5. The end of claim 4, wherein the annular ridged portion includes at least three ridges.

6. The end of claim 5, wherein the thickness of the three ridges is different at least one location in each of the respective ridges.

7. The end of claim 6, wherein the area of the circular panel is at least 24% of the total surface area of the can end.

8. The end of claim 7, wherein the area of the annular ridged portion is at least 42% of the total area of the can end.

9. The end of claim 8, wherein the metal is T4 steel.

10. The end of claim 9, wherein the panel material thickness is between 0.009 and 0.011 inches.

11. A one-piece can end formed from a single sheet of metal, the end comprising: an annular double seam formation having an outside formation material thickness; an annular ridged portion extending inwardly from the double seam formation; a substantially non-planar, circular panel extending from the annular ridged portion and having a panel material thickness, the outside formation material thickness being at least 1.15 times as thick as the panel material thickness; and the ridged portion has a portion material thickness, wherein the panel material thickness is at least 1.1 times as thick as the portion material thickness.

12. The end of claim 11, wherein the outside formation material thickness is at least 1.25 times as thick as the panel material thickness.

13. The end of claim 12, wherein at least 45% of the circular panel has a thickness within 6% of the panel material thickness.

14. The end of claim 3, wherein the annular ridged portion includes at least three ridges.

15. The end of claim 14, wherein the thickness of the three ridges is different at at least one location in each of the respective ridges.

16. The end of claim 15, wherein the area of the circular panel is at least 24% of the total surface area of the can end.

17. The end of claim 16, wherein the area of the annular ridged portion is at least 42% of the total surface area of the can end.

18. The end of claim 17, wherein the metal is T4 steel and the panel thickness is between 0.009 and 0.011 inches.

19. A one-piece can end formed from a single sheet of metal comprising:

a circular central panel having a first thickness and a flat inner portion and sloped outer portion contiguous with and surrounding the inner portion, the central panel comprising at least 24% of the total surface area of the can end;

a middle portion having a plurality of ridges and at least a second thickness, the first thickness being at least 1.1 times as thick as the second thickness, the middle portion contiguous with and extending radially from the sloped portion of the central panel and comprising at least 42% of the total surface area of the can end; and a curved end portion having at least a third thickness at least 1.15 times as thick as the first thickness, the curved end portion contiguous with and extending radially from the middle portion and configured to be rolled into a double seam.

* * * * *